US009217984B1

(12) United States Patent
Fujii

(10) Patent No.: US 9,217,984 B1
(45) Date of Patent: Dec. 22, 2015

(54) IMAGE CARRIER UNIT AND IMAGE FORMING APPARATUS INCLUDING SAME

(71) Applicant: KYOCERA Document Solutions Inc., Osaka (JP)

(72) Inventor: Hirokazu Fujii, Osaka (JP)

(73) Assignee: KYOCERA Document Solutions Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 14/728,629

(22) Filed: Jun. 2, 2015

(30) Foreign Application Priority Data

Jun. 3, 2014 (JP) ..... 2014-114839

(51) Int. Cl.
*G03G 21/00* (2006.01)

(52) U.S. Cl.
CPC ..... *G03G 21/0058* (2013.01)

(58) Field of Classification Search
CPC ..... G03G 21/0058; G03G 21/186; G03G 15/0225
See application file for complete search history.

(56) References Cited

U.S. PATENT DOCUMENTS 4,870,465 A * 9/1989 Lindblad ..... G03G 21/0005 399/347
2003/0185588 A1* 10/2003 Takami ..... G03G 21/1814 399/111
2007/0219079 A1* 9/2007 Tanaka ..... F16C 13/00 492/49
2009/0185830 A1* 7/2009 Kim ..... G03G 21/0058 399/222
2009/0297206 A1* 12/2009 Fujishiro ..... G03G 21/0058 399/100
2010/0278571 A1* 11/2010 Abe ..... G03G 21/0058 399/357
2011/0170902 A1* 7/2011 Nishikawa ..... G03G 21/0058 399/100
2011/0318051 A1* 12/2011 Kamimura ..... G03G 15/757 399/111
2012/0002998 A1* 1/2012 Kawai ..... G03G 21/0005 399/100
2012/0033981 A1* 2/2012 Fukuta ..... G03G 21/0058 399/12
2012/0076530 A1* 3/2012 Aoyagi ..... G03G 15/0258 399/100
2012/0189363 A1* 7/2012 Wakayama ..... G03G 21/0058 399/349
2013/0084103 A1* 4/2013 Hashimoto ..... G03G 15/5008 399/167
2013/0164028 A1* 6/2013 Morioka ..... G03G 21/1821 399/111
2013/0336694 A1* 12/2013 Kadota ..... G03G 21/0058 399/349
2014/0037320 A1* 2/2014 Berens ..... G03G 15/0225 399/100
2014/0099141 A1* 4/2014 Nishimura ..... G03G 15/0225 399/100

(Continued)

FOREIGN PATENT DOCUMENTS

JP 2012-150386 A 8/2012

*Primary Examiner* — Clayton E. Laballe
*Assistant Examiner* — Ruifeng Pu

(57) ABSTRACT

An image carrier unit includes: an image carrier; a cleaning roller collecting a residual toner remaining on a circumferential surface of the image carrier; a conveyance member receiving the residual toner and conveying the residual toner towards a one-end part side in a rotation-axis direction of the cleaning roller; and an operating mechanism making the cleaning roller perform thrust operation in the rotation-axis direction. The cleaning roller is obtained by spirally winding, around a roller circumferential surface a plurality of times, a base cloth of a long shape in which a plurality of brush bristles are implanted, and a plurality of wound areas formed on the roller circumferential surface by the winding have a downstream side of the roller circumferential surface in a side view from a direction orthogonal to a rotating shaft is directed towards the one-end part side in the rotation-axis direction.

9 Claims, 8 Drawing Sheets

(56) References Cited

U.S. PATENT DOCUMENTS

2014/0147159 A1* 5/2014 Nishiyama ..... G03G 21/1867 399/90
2014/0294415 A1* 10/2014 Maruta ..... G03G 15/80 399/67
2015/0034456 A1* 2/2015 Koshimura ..... B65H 3/0638 198/789
2015/0043940 A1* 2/2015 Tsuji ..... G03G 15/0225 399/100
2015/0093146 A1* 4/2015 Sato ..... G03G 21/1825 399/111
2015/0177648 A1* 6/2015 Morishita ..... G03G 21/105 399/358
2015/0277367 A1* 10/2015 Maeshima ..... G03G 21/1803 399/167

* cited by examiner

IMAGE CARRIER UNIT AND IMAGE FORMING APPARATUS INCLUDING SAME

INCORPORATION BY REFERENCE

This application claims priority to Japanese Patent Application No.2014-114839 filed on Jun. 3, 2014, the entire contents of which are incorporated by reference herein.

BACKGROUND

This disclosure relates to an image carrier unit cleaning a residual toner remaining on an image carrier, and an image forming apparatus including such an image carrier unit.

Typically, in an image forming apparatus adopting an electrophotographic process, an electrostatic latent image is formed on an image carrier based on image information, this electrostatic latent image is developed by a developing device to form a toner image on the image carrier, and then the toner image is transferred onto a recording medium.

In such an image forming apparatus, when the toner image on the image carrier formed of, for example, a photoconductive drum has been transferred onto the recording medium, a toner consequently remains on the image carrier, and this residual toner needs to be removed from the image carrier. Thus, for example, a cleaning device is arranged oppositely to the image carrier, and this cleaning device is used to remove and collect the residual toner.

A cleaning device as described above has a cleaning roller such as a fur brush roller and a conveyance member. The fur brush roller is driven into rotation in a manner such as to slide on and rub the image carrier to remove the residual toner on the image carrier. The conveyance member conveys the residual toner, which has been removed by the fur brush roller, to a toner waste port along a conveyance path.

SUMMARY

As one aspect of this disclosure, a technology obtained by improving the technology described above will be suggested.

An image carrier unit according to one aspect of this disclosure includes: an image carrier, a fur brush roller, a conveyance member, and an operating mechanism.

On the image carrier, a toner image is formed.

The fur brush roller rotates while making contact with the image carrier to collect a residual toner remaining on a circumferential surface of the image carrier.

The conveyance member receives the residual toner collected by the fur brush roller, and conveys the residual toner towards a one-end part side in a rotation-axis direction of the fur brush roller.

The operating mechanism makes the fur brush roller perform thrust operation in the rotation-axis direction of the fur brush roller, The fur brush roller is obtained by spirally winding, around a roller circumferential surface a plurality of times, a base cloth of a long shape in which a plurality of brush wire bristles are implanted, and a plurality of wound areas formed on the roller circumferential surface by the winding have a downstream side of the roller circumferential surface in a side view from a direction orthogonal to a rotating shaft is directed towards the one-end part side in the rotation-axis direction.

The operating mechanism includes: a coupling gear, a pressing member, and a freely fitting gear.

The coupling gear engages with a rotational driving gear providing a rotational driving force, and is also coupled to a rotating shaft of the fur brush roller in a manner such as to be capable of rotating together therewith.

The pressing member presses the coupling gear and the fur brush roller to the one-end part side of the fur brush roller in the rotation-axis direction.

The freely fitting gear is located closer to the one-end part side in the rotating-axis direction than the coupling gear, is freely fitted to the rotating shaft of the fur brush roller in a state in which a movement thereof in the rotation-axis direction at a position opposing the coupling gear is regulated, also engages with the rotational driving gear, and rotates at a rotation speed different from a rotation speed of the coupling gear in a number of teeth different from a number of teeth of the coupling gear.

Further, at each of opposing side surface parts on the coupling gear and the freely fitting gear arranged oppositely to each other, the operating mechanism has a bumpy shape formed of a convex part and a concave part whose height in the rotation-axis direction varies continuously along a circumferential direction with the rotation-axis as a center.

DETAILED DESCRIPTION

Figure 1:
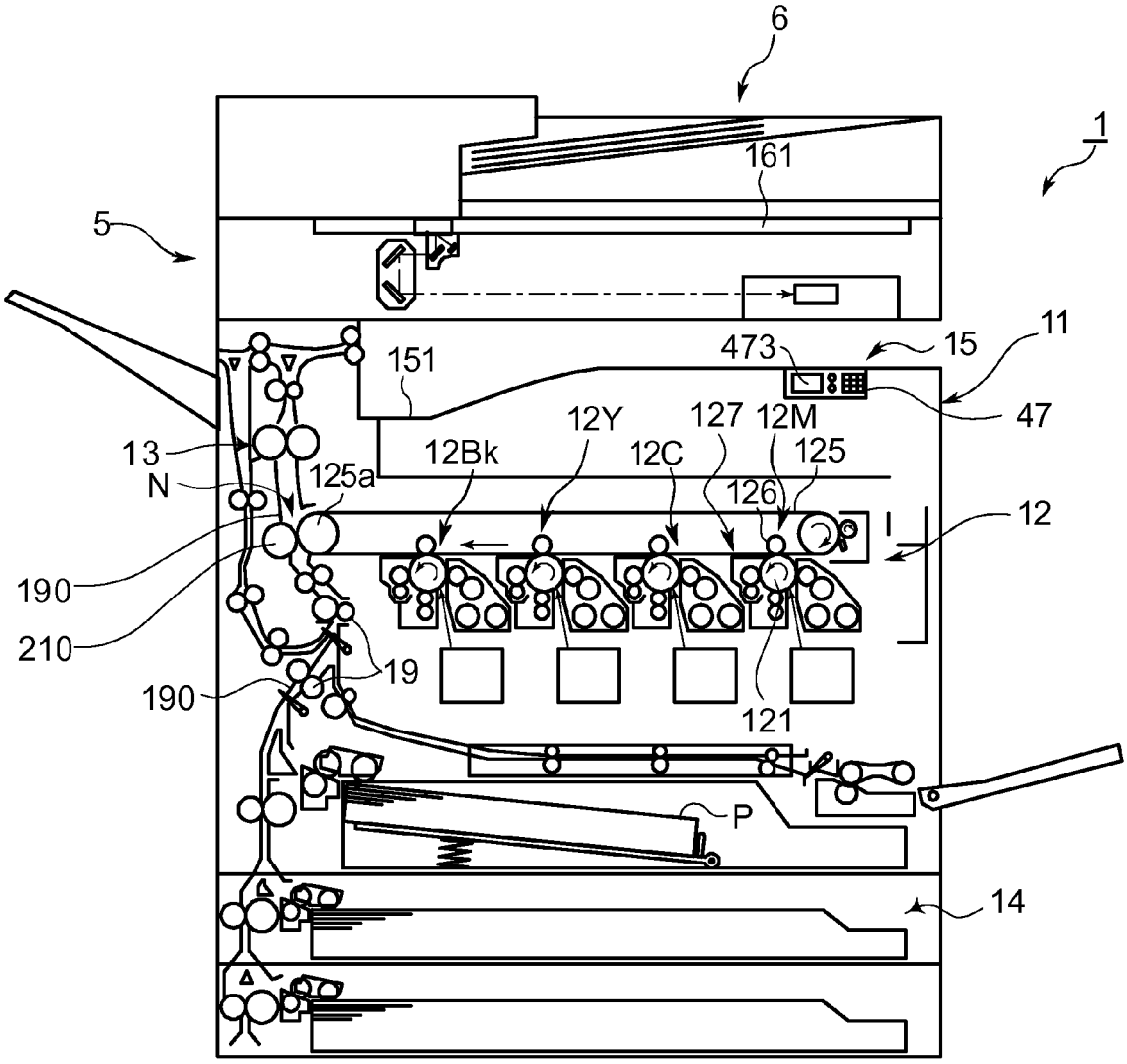
FIG. 1 is a front sectional view showing a structure of an image forming apparatus according to one embodiment of this disclosure.
Figure 2:
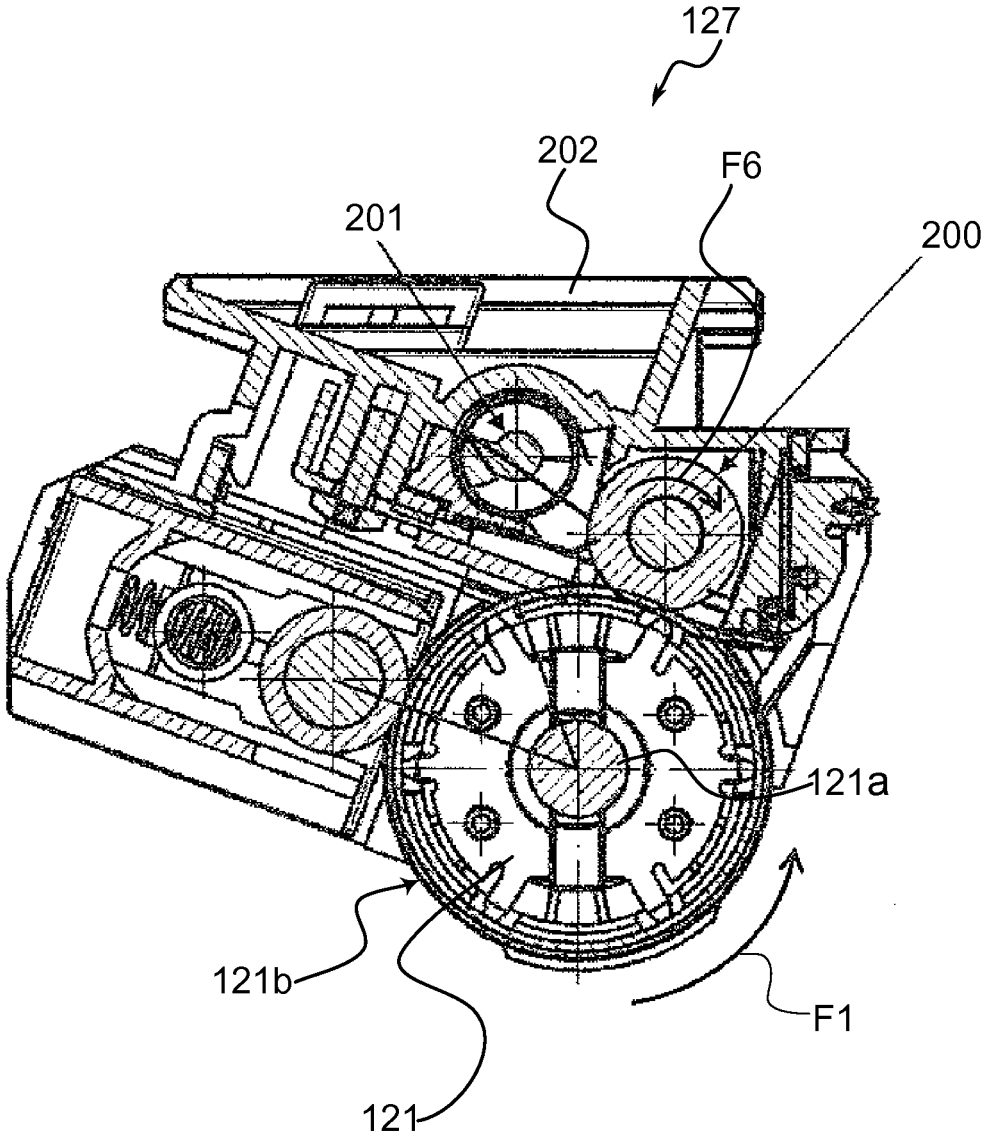
FIG. 2 is a side sectional view showing inner configuration of a drum unit.
Figure 3:
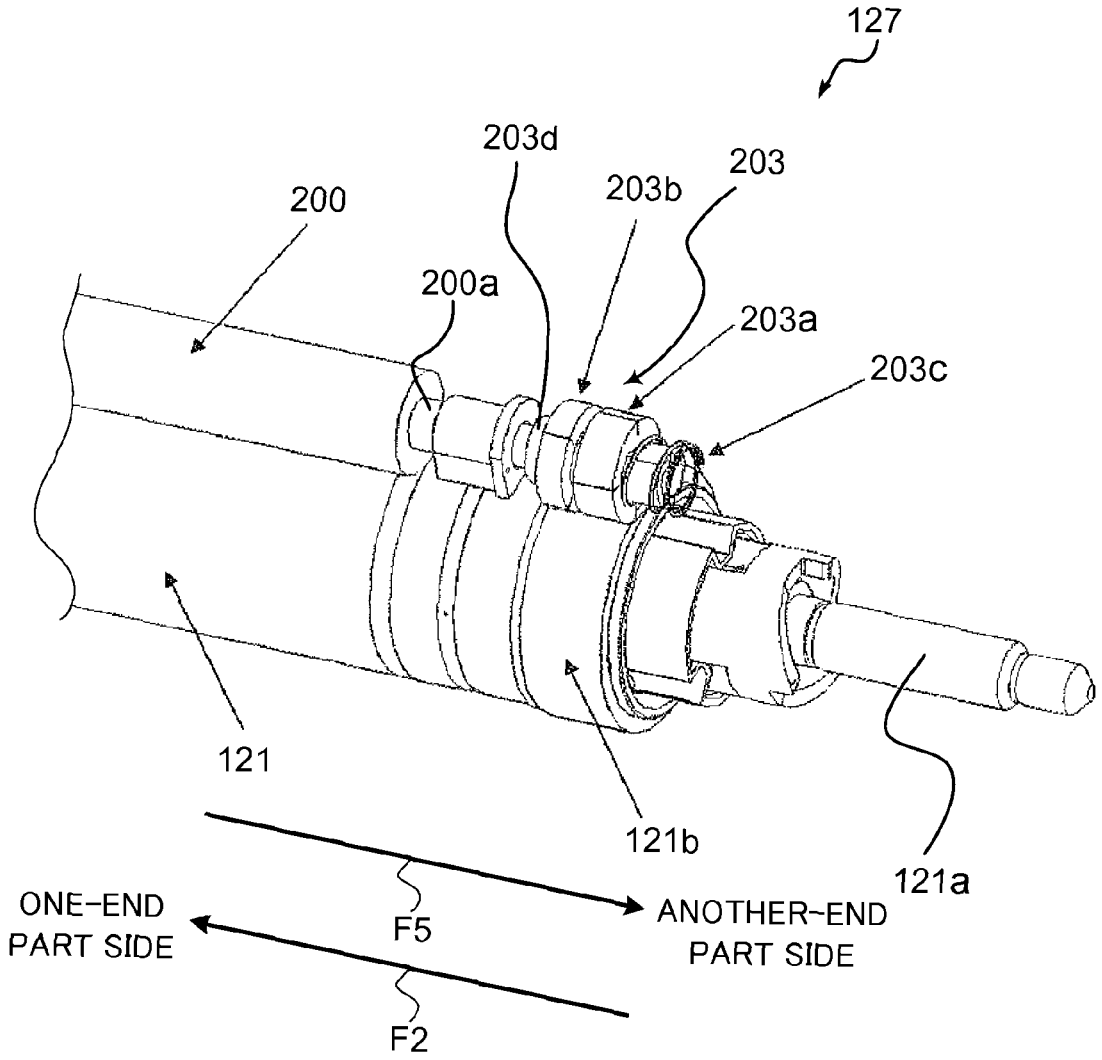
FIG. 3 is a partial perspective view of the drum unit.

Hereinafter, an image forming apparatus according to one embodiment of this disclosure will be described with reference to the drawings. FIG. 1 is a front sectional view showing a structure of the image forming apparatus according to one embodiment of this disclosure. FIG. 2 is a side sectional view showing inner configuration of a drum unit 127. FIG. 3 is a partial perspective view of the drum unit 127. The drum unit 127 is one example of an image carrier unit in the scope of the claims.

The image forming apparatus according to one embodiment of this disclosure is a multifunction peripheral combining a plurality of functions such as, for example, a copy function, a printer function, a scanner function, and a facsimile function. The image forming apparatus 1 includes: an apparatus body 11, an operation section 47, a display section 473, an image formation section 12, a fixing section 13, a paper feed section 14, an original copy feed section 6, an original copy reading section 5, etc.

For original copy reading operation performed by the image forming apparatus 1, an image of an original copy fed by the original copy feed section 6 or an original copy loaded on original copy loading glass 161 is optically read by the original copy reading section 5 to generate image data.

For image formation operation performed by the image forming apparatus 1, based on, for example, the image data generated through the aforementioned original copy reading operation, the image formation section 12 forms a toner image on paper P as a recording medium fed from the paper feed section 14. In order to perform color printing, a magenta image formation unit 12M, a cyan image formation unit 12C, an yellow image formation unit 12Y, and a black image formation unit 12Bk of the image formation section 12, based on images composed of respective color components forming the aforementioned image data, respectively form toner images on photoconductive drums 121 through charging, exposure, and development processes, and transfer these toner images onto an intermediate transfer belt 125 by primary transfer rollers 126. The image formation section 12 is one example of each of a charging unit, an exposing unit, a developing unit, and a transfer unit in the scope of the claims. The photoconductive drum 121 is one example of the image carrier unit in the scope of the claims.

The aforementioned toner images of the respective colors transferred onto the intermediate transfer belt 125 are superposed on one another on the intermediate transfer belt 125 through transfer timing adjustment, turning into a color toner image. A secondary transfer roller 210, at a nip part N formed with a drive roller 125*a* with the intermediate transfer belt 125 in between, transfers this color toner image formed on the surface of the intermediate transfer belt 125 onto the paper P conveyed from the paper feed section 14 through a conveyance path 190. Then the fixing section 13 fixes the toner image on the paper P thereon through thermal compression. The paper P on which the color image has already been formed through fixing processing is discharged to a discharge tray 151.

On a side of the photoconductive drum 121, a drum unit 127 is arranged. The drum unit 127 performs cleaning by removing a residual toner adhering to a surface of the photoconductive drum 121. Details of the drum unit 127 will be described later.

Next, configuration of the drum unit 127 will be described in detail.

As shown in FIG. 2, the drum unit 127 has: in a circumferential direction of the photoconductive drum 121 (a direction of an arrow F1), a fur brush roller 200, a toner conveying screw 201, and a housing 202 storing the fur brush roller 200 and the toner conveying screw 201. The toner conveying screw 201 is one example of a conveyance member in the scope of the claims. The fur brush roller 200 is one example of a cleaning roller in the scope of the claims.

The photoconductive drum 121, as shown in FIG. 3, includes: a drive shaft 121*a* extending in a rotation-axis direction of the fur brush roller 200; and a drum flange gear 121*b* providing a rotational driving force to the photoconductive drum 121. The drum flange gear 121*b* is one example of a rotational driving gear in the scope of the claims.

The fur brush roller 200, as shown in FIGS. 2 and 3, is in contact with a circumferential surface of the photoconductive drum 121, and rotates in a direction (a direction of an arrow F6 of FIG. 2) opposite to the circumferential direction of the photoconductive drum 121 (the direction of the arrow F1 of FIG. 2). The fur brush roller 200 scrapes off the residual toner on the photoconductive drum 121 and also conveys the scraped residual tonner to the toner conveying screw 201.

Figure 4:
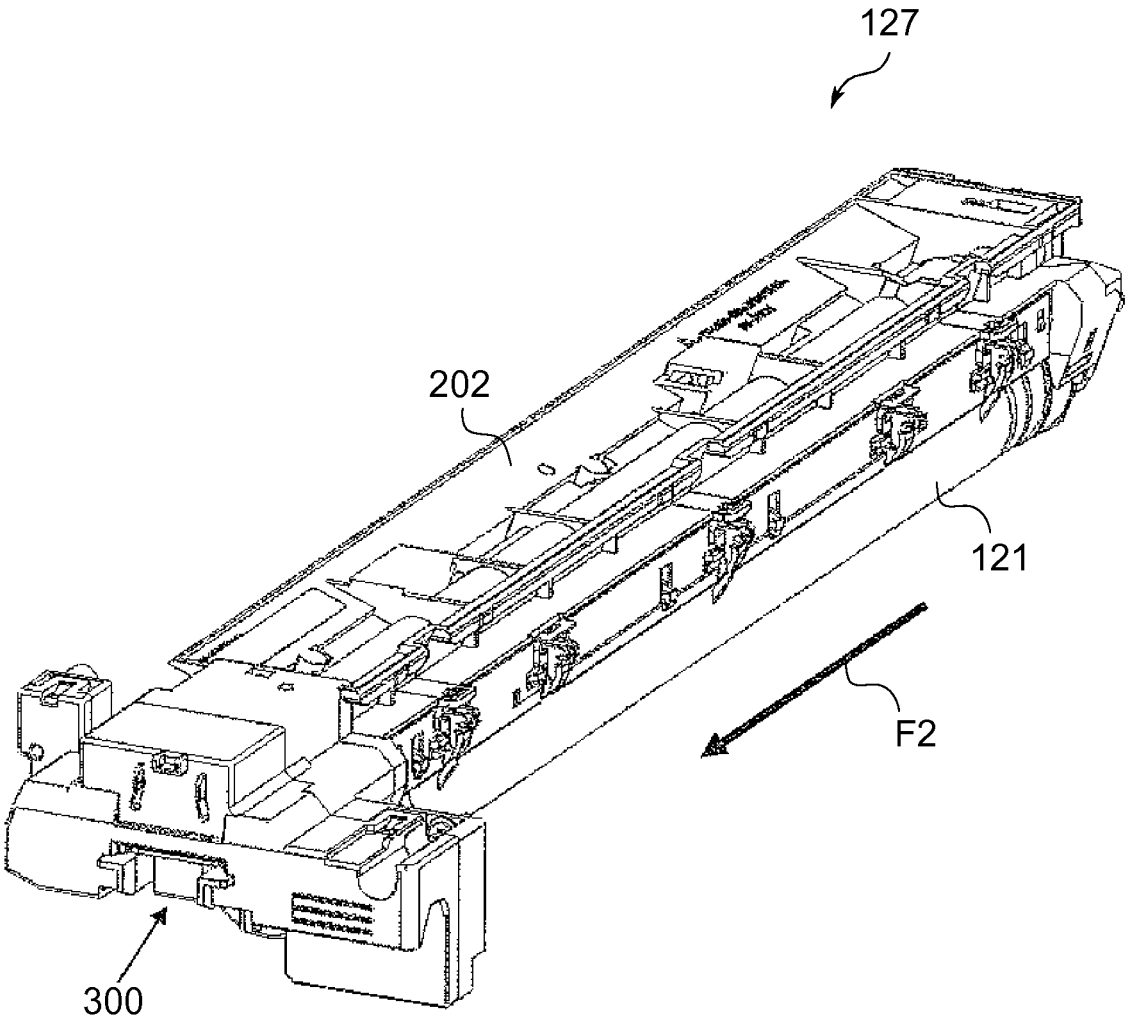
FIG. 4 is an external perspective view showing configuration of the drum unit.
Figure 5:
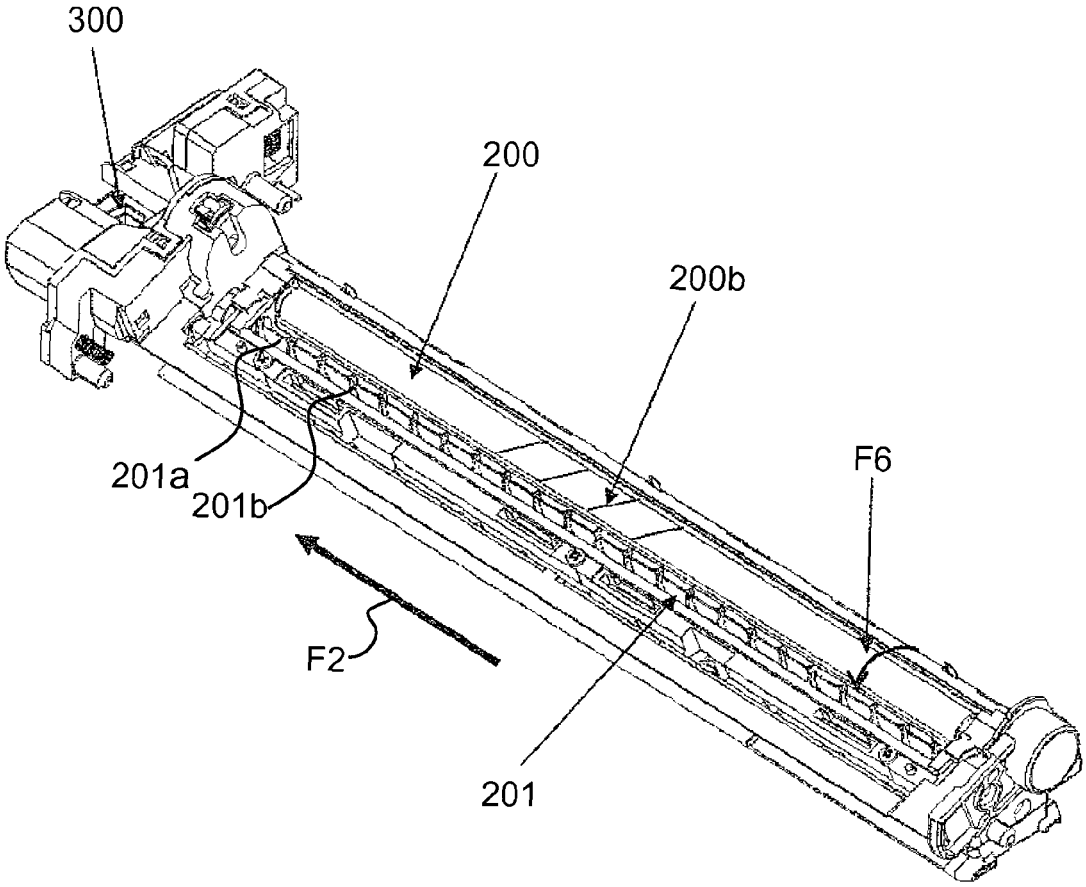
FIG. 5 is a perspective view showing a state in which a photoconductive drum has been removed from the drum unit.

FIG. 4 is a perspective view showing configuration of the drum unit 127. FIG. 5 is a perspective view showing a state in which the photoconductive drum 121 has been removed from the drum unit 127. The toner conveying screw 201, as shown in FIG. 5, has a rotating shaft 201*a*. Around a circumferential surface of this rotating shaft 201*a*, a toner conveying blade 201*b* is spirally wound. The toner conveying screw 201 receives the residual toner collected by the fur brush roller 200, and conveys the received residual toner towards a one-end part side in the rotation-axis direction of the fur brush roller 200 to a toner waste port 300 (see FIGS. 4 and 5).

Figure 6:
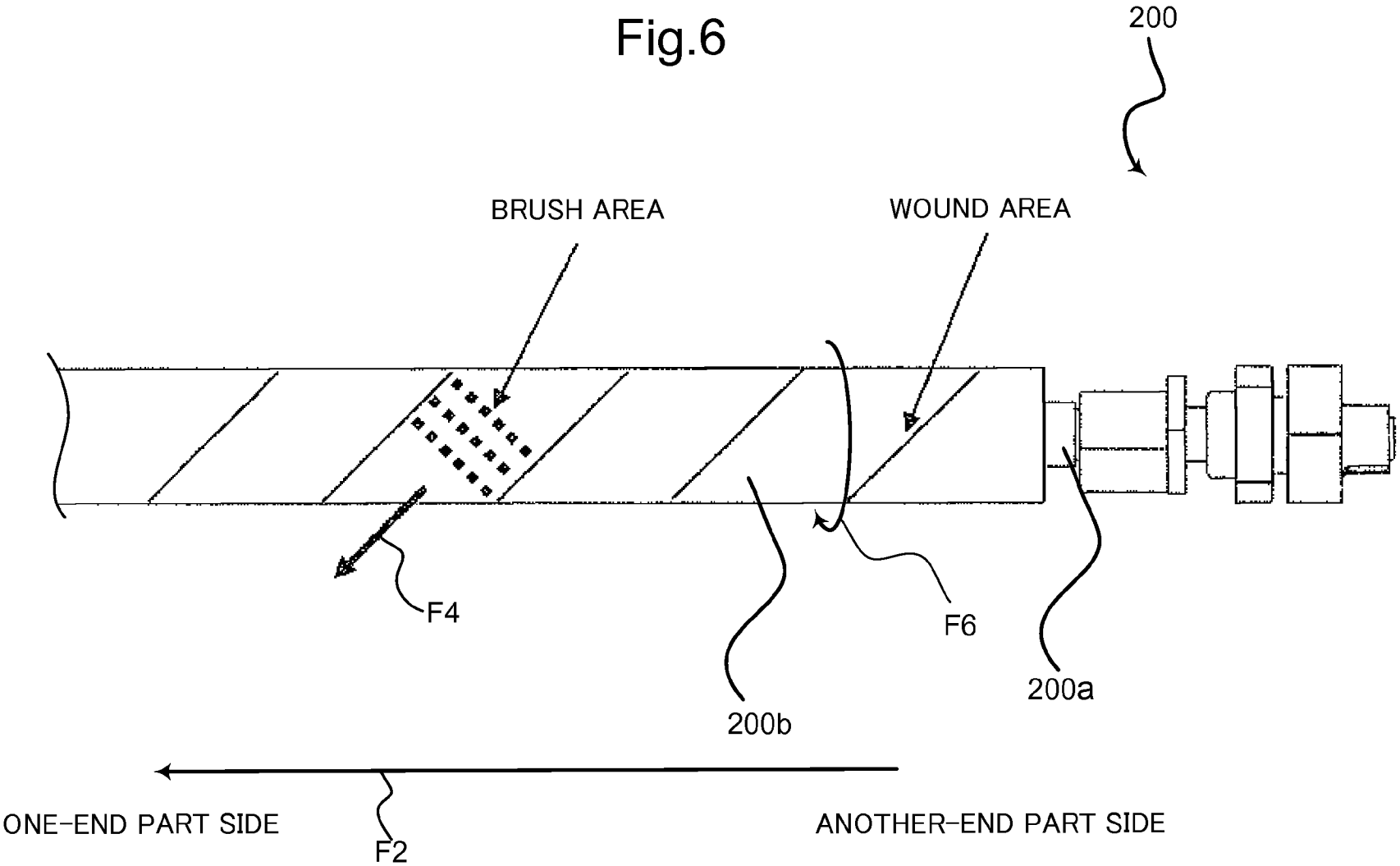
FIG. 6 is a view showing wound areas formed on a circumferential surface of a base shaft by winding a base cloth therearound.

FIG. 6 is a view showing wound areas formed on the circumferential surface of the rotating shaft 200*a* by winding a base cloth 200*b* therearound. Black dots in FIG. 6 show brush areas of brush bristles woven into the base cloth 200*b*. Diagonal lines of FIG. 6 show the wound areas formed on the circumferential surface of the rotating shaft 200*a* by winding the base cloth 200*b* therearound. As shown in FIG. 6, the fur brush roller 200 has: the rotating shaft 200*a* and the base cloth 200*b* on a roller circumferential surface. The fur brush roller 200 is formed by spirally winding the base cloth 200*b* of a long shape, in which brush bristles are implanted, around the circumferential surface of the rotating shaft 200*a* a plurality of times. The basic cloth 200*b* is wound around the circumferential surface of the rotating shaft 200*a*.

In this embodiment, as shown in FIG. 6, the plurality of wound areas formed on the roller circumferential surface by winding the base cloth 200*b* therearound has, in a side view from a direction orthogonal to the rotating shaft 200*a*, a downstream side of the roller circumferential surface directed to the one-end part side (the direction of the arrow F2) in the rotation-axis direction of the fur brush roller 200. This permits brush areas of the brush bristles woven into the base cloth 200*b* to flick the residual toner not only in the rotation direction (the arrow F6) of the fur brush roller 200 but also in a direction along the plurality of wound areas (a direction of an arrow F4) when the far brush roller is in rotational operation. Using a force of this flicking for conveyance towards the one-end part side in the rotation-axis direction of the fur brush roller 200 (the direction of the arrow F2) can create a flow of conveyance of the residual toner to the toner waste port 300 (see FIG. 4) not only by the toner conveyance towards the one-end part side in the rotation-axis direction (the direction of the arrow F2) by the toner conveying screw 201 but also by the rotational operation of the fur brush roller 200.

The drum unit 127 of this embodiment, as shown in FIG. 3 described above, further includes an operating mechanism 203. This operating mechanism 203 converts the rotational movement of the fur brush roller 200 into a reciprocating movement (thrust movement) in which the fur brush roller 200 reciprocates between the one-end part side (the direction of the arrow F2) and an another-end part side (a direction of an arrow F5) both in the rotation-axis direction of the fur brush roller 200. Hereinafter, configuration of this operating mechanism 203 will be described in detail.

As shown in FIG. 3, the operating mechanism 203 includes: a brush drive gear 203*a*, a brush thrusting transfer gear 203*b*, a thrust bias spring 203*c*, and a regulating member 203*d*.

As shown in FIG. 3, the brush drive gear 203 a is externally fitted to the rotating shaft 200*a* of the fur brush roller 200 and also coupled thereto in a manner such as to be capable of rotating therewith, and also engages with a drum brush gear 121*b* of the photoconductive drum 121. The brush drive gear 203*a* rotates in a direction opposite to a rotation direction of the drum flange gear 121*b*. The brush drive gear 203*a* is one example of a coupling gear in the scope of the claims.

The thrust bias spring 203*c* provides a bias force biasing the brush drive gear 203*a* and the fur brush roller 200 towards the aforementioned one-end part side (the direction of the arrow F2) of the fur brush roller 200 in the rotation-axis direction of the fur brush roller 200, thereby pressing the fur brush roller 200 towards the aforementioned one-end part side (the direction of the arrow F2). The thrust bias spring 203*c* is one example of a pressing member in the scope of the claims.

The brush thrusting transfer gear 203*b* is located closer to the aforementioned one-end part side (the direction of the arrow F2) in the rotation-axis direction of the fur brush roller 200 than the brush drive gear 203*a*, is freely fit with the rotating shaft 200*a* of the fur brush roller 200 while its movement in the aforementioned rotation-axis direction at a position opposing the brush drive gear 203*a* is regulated, engages with the drum flange gear 121*b*, and rotates at a rotation speed different from that of the brush drive gear 203*a* in the number of teeth different from that of the brush drive gear 203*a*. The number of teeth of the brush thrusting transfer gear 203*b* (for example, 12 teeth) is smaller by one than the number of teeth of the brush drive gear 203*a* (for example, 13 teeth). The brush thrusting transfer gear 203*b* is one example of a freely fitting gear in the scope of the claims.

The regulating member 203*d*, at a position closer to the aforementioned one-end part side in the rotation-axis direction of the fur brush roller 200 than the brush thrusting transfer gear 203*b*, is externally fitted to the rotating axis 200*a* and coupled thereto in a manner such as to be capable of rotating together therewith, and regulates movement of the brush thrusting transfer gear 203*b*, which has been biased towards the aforementioned one-end part side in the rotation-axis direction via the brush drive gear 203*a* by the thrust bias spring 203*c*, closer to the aforementioned one-end part side (the direction of the arrow F2) in the rotation-axis direction than the stop position described above.

Figure 7A:
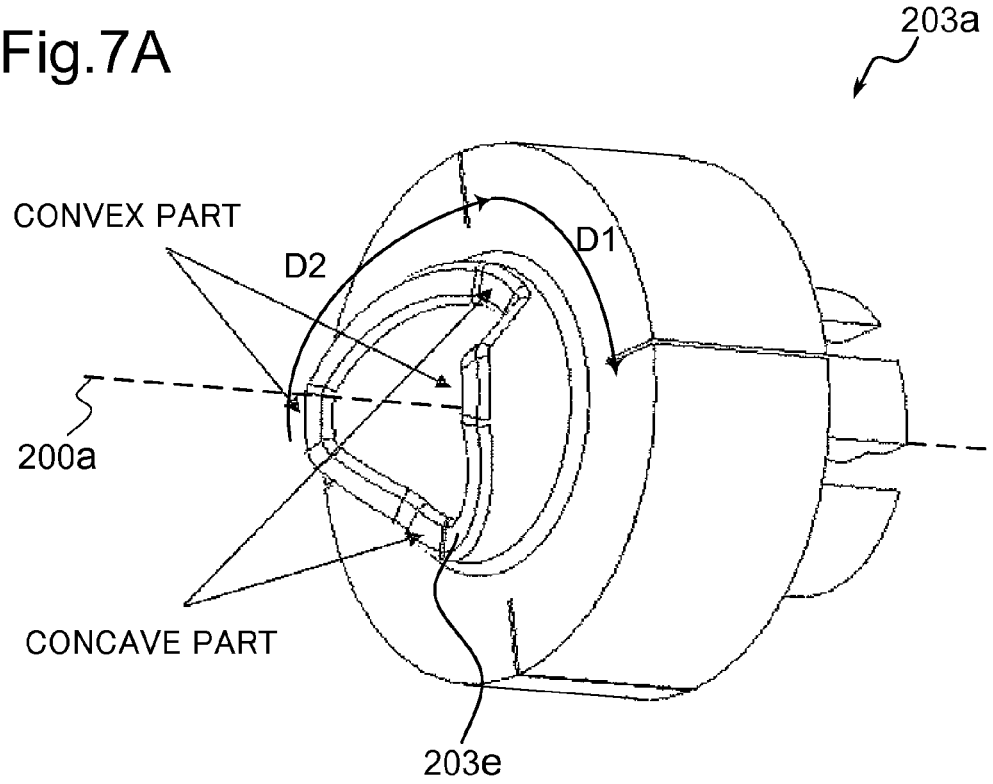
FIG. 7A is a view illustrating a bumpy shape formed at a side surface part of a brush drive gear.
Figure 7B:
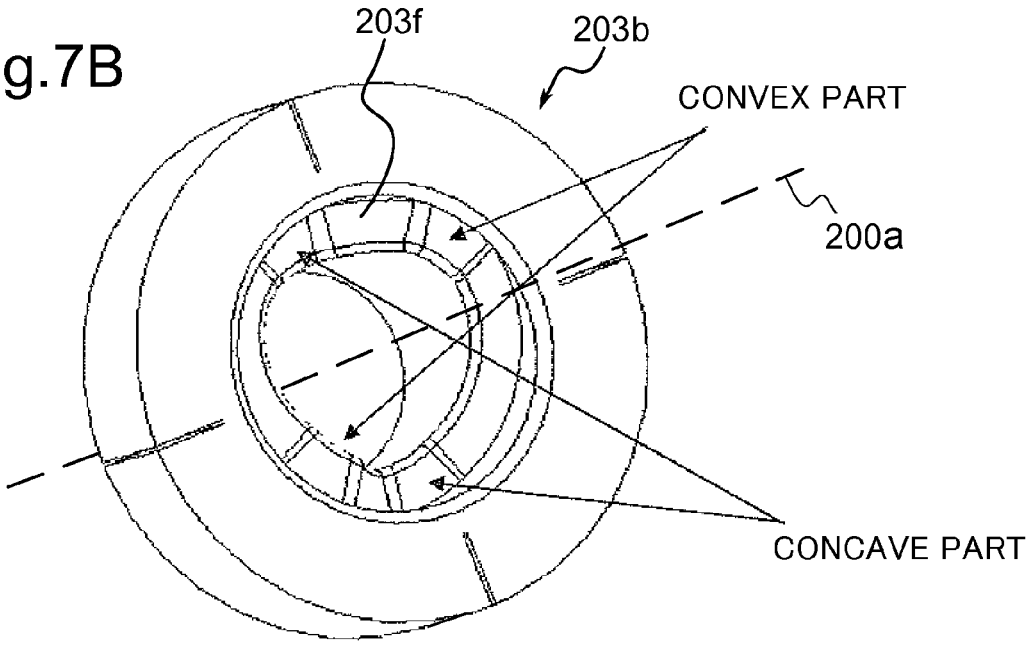
FIG. 7B is a view illustrating a bumpy shape formed at a side surface part of a brush thrusting transfer gear.
Figure 8:
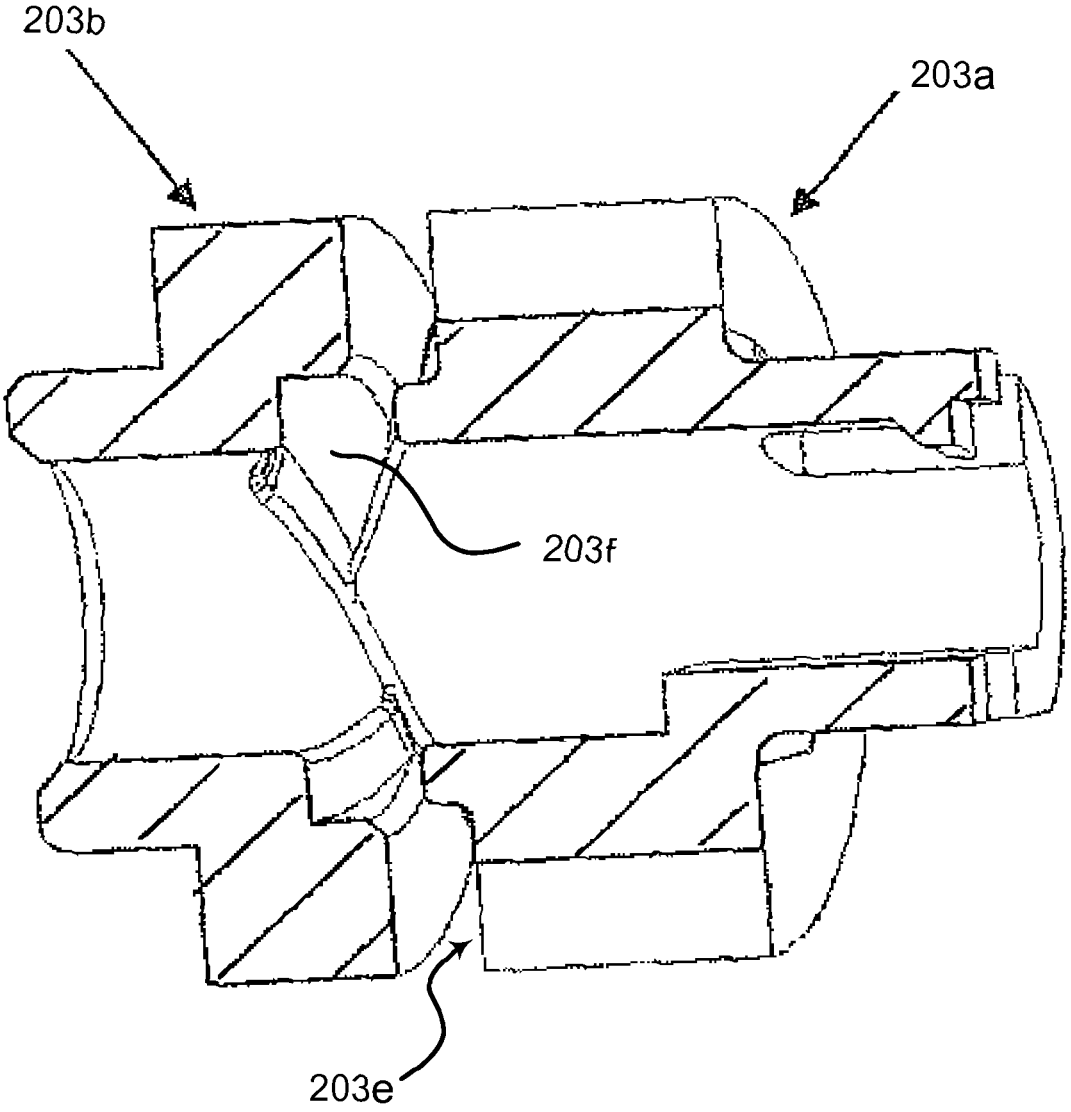
FIG. 8 is a schematic sectional view of the brush drive gear and the brush thrusting transfer gear.

FIG. 7A is a view illustrating a bumpy shape formed on a side surface part of the brush drive gear 203*a*. FIG. 7B is a view illustrating a bumpy shape formed on a side surface part of the brush thrusting transfer gear 203*b*. FIG. 8 is a schematic sectional view of the brush drive gear 203 a and the brush thrusting transfer gear 203*b*. As shown in FIGS. 7A and 7B, at the opposing side surface parts 203*e* and 203*f* in the brush drive gear 203*a* and the brush thrusting transfer gear 203*b* arranged oppositely to each other, the bumpy shapes formed of convex parts and concave parts whose height in the rotation-axis direction of the fur brush roller 200 varies continuously are formed along the circumferential direction with respect to the rotating shaft 200*a* as a center.

As shown in FIGS. 7A and 7B, for example, the aforementioned bumpy shape provided at the side surface part 203*e* of the brush drive gear 203*a*, in a rotation direction relative to the brush thrusting transfer gear 203*b*, has a circumferential distance D1 from the convex part to the concave part which is shorter than a circumferential distance D2 from the concave part to the convex part. Directions of arrows D1 and D2 in FIG. 7A show directions in which the brush drive gear 203*a* rotates relatively to the brush thrusting transfer gear 203*b*. Moreover, directions of arrows D3 and D4 in FIG. 7B show directions in which the brush thrusting transfer gear 203*b* rotates relatively to the brush drive gear 203*a*.

Hereinafter, the reciprocating movement of the fur brush roller 200 will be described in detail with reference to FIGS. 3 and 7.

As shown in FIGS. 7A and 7B, each of the side surface parts 203*e* and 203*f* is provided with the two concave parts and the two convex parts. Since the number of teeth of the brush thrusting transfer gear 203*b* (for example, 12 teeth) is smaller by one than the number of teeth of the brush drive gear 203*a* (for example, 13 teeth), each time the brush drive gear 203*a* and the brush thrusting transfer gear 203*b* rotate, the brush thrusting transfer gear 203*b* advances forward of the brush drive gear 203*a* by one tooth. Specifically, the brush thrusting transfer gear 203*b* rotates relatively to the brush drive gear 203*a* while advancing by an amount corresponding to one tooth. Following this rotation, the convex parts provided at the side surface part 203*e* of the brush thrusting transfer gear 203*b* move up and down the two convex parts provided at the side surface part 203*e* of the brush drive gear 203*a*. Then as a result of this upward and downward movement, while the brush thrusting transfer gear 203*b* makes one rotation relatively to the brush drive gear 203*a*, the fur brush roller 200 makes a reciprocating movement twice in the rotation-axis direction.

First, from the convex part to the concave part provided at the side surface part 203*e* of the brush drive gear 203*a*, the convex part of the brush thrusting transfer gear 203*b* is caused to rotate by the circumferential distance D1 relatively to the brush drive gear 203*a*. Here, a rotation angle is preferably smaller than a predefined reference angle (for example, 90 degrees). At time of this rotation operation, the convex part provided at the side surface part 203*f* of the brush thrusting transfer gear 203*b* moves down from the convex part to the concave part of the side surface part 203*e* of the brush drive gear 203*a* x. At this point, the thrust bias spring 203*c* (see FIG. 3) presses the brush drive gear 203*a* and the fur brush roller 200 towards the aforementioned one-end part side (in the direction of the arrow F2 of FIG. 3) in the rotation-axis direction by an amount corresponding to a height at which the downward movement was made by the convex part of the brush thrusting transfer gear 203*b*, and moves the fur brush roller 200 towards the aforementioned one-end part side in the rotation-direction.

Then from the concave part to the convex part provided at the side surface part 203*e* of the brush drive gear 203*a*, the convex part of the brush thrusting transfer gear 203*b* is rotated by the circumferential distance D2 relatively to the brush drive gear 203*a*. At time of this rotation operation, the convex part provided at the side surface part 203*f* of the brush thrusting transfer gear 203*b* moves up from the concave part to the convex part of the side surface part 203*e* of the brush drive gear 203*a*. At this point, the brush thrusting transfer gear 203*b* presses the brush drive gear 203*a* and the fur brush roller 200 towards the another-end part side in the rotation-axis direction (the direction of the arrow F5 of FIG. 3) against a pressing force of the thrust bias spring 203*c* by an amount corresponding to a height at which the convex part of the brush thrusting transfer gear 203*b* has moved up, and moves the fur brush roller 200 towards the another-end part side in the rotation-axis direction.

In this embodiment, the bumpy shape provided at the side surface part 203*e* of the brush drive gear 203*a* is configured such that the circumferential distance D1 from the convex part to the concave part is shorter than the circumferential distance D2 from the concave part to the convex part. The circumferential distance D1 by which the convex part of the brush thrusting transfer gear 203*b* moves down from the convex part to the concave part of the side surface part 203*e* of the brush drive gear 203*a* when the thrust bias spring 203*c* presses the fur brush roller 200 towards the aforementioned one-end part side in the rotation-axis direction is shorter than the circumferential distance D2 by which the convex part of the brush thrusting transfer gear 203*b* moves up from the concave part to the convex part of the side surface part 203*e* of the brush drive gear 203*a* when the brush thrusting transfer gear 203*b* presses the fur brush roller 200 towards the another-end part side in the rotation-axis direction. Therefore, time during which the convex part of the brush thrusting transfer gear 203*b* moves down from the convex part to the concave part of the side surface part 203*e* of the brush drive gear 203*a* can be made shorter than time during which the convex part of the brush thrusting transfer gear 203*b* moves up from the concave part to the convex part of the side surface part 203*e* of the brush drive gear 203*a*. As a result, a moving speed at which the fur brush roller 200 is pressed by the thrust bias spring 203*c* to move to the aforementioned one-end part side in the rotation-axis direction can be made faster than a moving speed at which the fur brush roller 200 is pressed by the brush thrusting transfer gear 203*b* to move to the aforementioned another-end part side in the rotation-axis direction.

As described above, since the moving speed at which the fur brush roller 200 moves to the aforementioned one-end part side in the rotation-axis direction is larger than the moving speed at which the fur brush roller 200 moves to the aforementioned another-end part side in the rotation-axis direction, the moving speed at which it moves to the aforementioned one-end part side in the rotation-axis direction can be increased to permit the fur brush roller 200 to swiftly flick the residual toner, while the moving speed at which the fur brush roller 200 moves to the aforementioned another-end part side in the rotation-axis direction can be decreased to permit the fur brush roller 200 to refrain from flicking the residual toner as much as possible. This permits creation of a flow conveyed to the aforementioned one-end part side in the rotation-axis direction by, in addition to an operation of conveying the residual toner to the aforementioned one-end part side in the rotation-axis direction by the toner conveying screw 201, but also by the reciprocation of the fur brush roller 200 in the rotation-axis direction. This consequently can improve residual toner conveyance performance more than in a case where only the toner conveying screw 201 is used to convey the residual toner.

Moreover, in this embodiment, the fur brush roller 200 rotating while making contact with the photoconductive drum 121 performs thrust operation between the one-end part side and the another-end part side described above in the rotation-axis direction, which can therefore shorten time during which the brush bristles of the fur brush roller 200 make contact with the same portion of the photoconductive drum 121. This consequently can more suppress appearance of a bristle pattern of the brush bristles on the photoconductive drum 121 than in a conventional case.

For example, a fur brush roller provided in a typical cleaning device has a role of conveying a residual toner removed from an image carrier to a conveying member, but does not have a role of conveying the residual toner to a toner waste port along a conveyance path. In this cleaning device, the conveyance of the residual toner to the toner waste port is performed only by the conveyance member. Therefore, it is desirable that in such a cleaning device, the conveyance of the residual toner to the toner waste port be also performed by the far brush roller, which leaves space for an improvement in the residual toner conveyance performance Moreover, such a typical cleaning device obtains a driving force for driving a fur brush roller into rotation from a rotating shaft of an image carrier, and thus depending on a gear ratio of a drive gear for obtaining the driving force from the rotating shaft, the time during which the brush bristles of the fur brush roller make contact with the same portion of the image carrier becomes longer, thereby raising a problem that a bristle pattern of the brush bristles appears on the image carrier.

On the contrary, with this embodiment, while improving the residual toner conveyance performance than in a conventional case by performing the conveyance of the residual toner not only by the toner conveying screw 201 but also by the fur brush roller 200, the appearance of the bristle pattern of the brush bristles on the photoconductive drum 121 can be more suppressed than in the conventional case.

What is claimed is:

1. An image carrier unit comprising:

an image carrier on which a toner image is formed;

a cleaning roller rotating while making contact with the image carrier to collect a residual toner remaining on a circumferential surface of the image carrier;

a conveyance member receiving the residual toner collected by the cleaning roller, and conveying the residual toner towards a one-end part side in a rotation-axis direction of the cleaning roller; and an operating mechanism making the cleaning roller perform thrust operation in the rotation-axis direction of the cleaning roller, wherein the operating mechanism includes:

a coupling gear engaging with a rotational driving gear providing a rotational driving force, and also being coupled to a rotating shaft of the cleaning roller in a manner such as to be capable of rotating together therewith;

a pressing member pressing the coupling gear and the cleaning roller to the one-end part side of the cleaning roller in the rotation-axis direction; and a freely fitting gear being located closer to the one-end part side in the rotating-axis direction than the coupling gear, being freely fitted to the rotating shaft of the cleaning roller in a state in which a movement thereof in the rotation-axis direction at a position opposing the coupling gear is regulated, also engaging with the rotational driving gear, and rotating at a rotation speed different from a rotation speed of the coupling gear in a number of teeth different from a number of teeth of the coupling gear, and at each of opposing side surface parts on the coupling gear and the freely fitting gear arranged oppositely to each other, a bumpy shape formed of a convex part and a concave part whose height in the rotation-axis direction varies continuously is formed along a circumferential direction with the rotation-axis as a center.

2. The image carrier unit according to claim 1, wherein the cleaning roller is a fur brush, the cleaning roller is obtained by spirally winding, around a roller circumferential surface a plurality of times, a base cloth of a long shape in which a plurality of brush bristles are implanted, and a plurality of wound areas formed on the roller circumferential surface by the winding have a downstream side of the roller circumferential surface in a side view from a direction orthogonal to the rotating shaft is directed towards the one-end part side in the rotation-axis direction.

3. The image carrier unit according to claim 1, wherein the bumpy shape provided at the side surface part of the coupling gear is configured such that in a rotation direction relative to the freely fitting gear, a circumferential distance from the convex part to the concave part is shorter than a circumferential directed from the concave part to the convex part.

4. The image carrier unit according to claim 3, wherein a moving speed at which the cleaning roller is pressed by the pressing member to move to the one-end part side in the rotation-axis direction of the cleaning roller is faster than a moving speed at which the cleaning roller is pressed by the freely fitting gear to move to an another-end part side in the rotation-axis direction.

5. The image carrier unit according to claim 1, wherein the number of teeth of the freely fitting gear is smaller than the number of teeth of the coupling gear by one.

6. The image carrier unit according to claim 1, wherein a rotation angle at which the freely fitting gear is rotated relatively to the coupling gear from the convex part to the concave part provided at the side surface part of the coupling gear is smaller than a predefined reference angle.

7. The image carrier unit according to claim 6, wherein the bumpy shape provided at the side surface part of the coupling gear is formed of two concave parts and two convex parts, and in a case where, while the freely fitting gear makes one rotation relatively to the coupling gear, the convex part provided at the side surface part of the freely fitting gear moves up and down the two convex parts provided at the side surface part of the coupling gear and the cleaning roller reciprocates twice in the rotation-axis direction, the reference angle is 90 degrees.

8. The image carrier unit according to claim 6, wherein the bumpy shape provided at the side surface part of the coupling gear is composed of one concave part and one convex part, and in a case where, while the freely fitting gear makes one rotation relatively to the coupling gear, the convex part provided at the side surface part of the freely fitting gear moves up and down the one convex part provided at the side surface part of the coupling gear and the cleaning roller reciprocate once in the rotation-axis direction, the reference angle is 180 degrees.

9. An image forming apparatus comprising:

an image carrier unit;

a charging unit charging a surface of an image carrier;

an exposing unit forming an electrostatic latent image on the charged image carrier;

a developing unit depositing a toner to the image carrier on which the electrostatic latent image has been formed to thereby form a toner image; and a transfer unit transferring the toner image to a transferred body, wherein the image carrier unit includes:

an image carrier on which a toner image is formed;

a cleaning roller rotating while making contact with the image carrier to collect a residual toner remaining on a circumferential surface of the image carrier;

a conveyance member receiving the residual toner collected by the cleaning roller and conveying the toner towards a one-end part side in a rotation-axis direction of the cleaning roller; and an operating mechanism making the cleaning roller perform thrust operation in the rotation-axis direction of the cleaning roller, the operating mechanism includes:

a coupling gear engaging with a rotational driving gear providing a rotational drive force and also being coupled to a rotating shaft of the cleaning roller in a manner such as to be capable of rotating together therewith;

a pressing member pressing the coupling gear and the cleaning roller towards the one-end part side of the cleaning roller in the rotation-axis direction; and a freely fitting gear being located closer to the one-end part side in the rotation-axis direction than the coupling gear, being freely fitted to the rotating shaft of the cleaning roller in a state in which a movement thereof in the rotation-axis direction at a position opposing the coupling gear is regulated, engaging with the rotational driving gear, and rotating at a rotation speed different from a rotation speed of the coupling gear in a number of teeth different from a number of teeth of the coupling gear, and on each of opposing side surface parts in the coupling gear and the freely fitting gear arranged oppositely to each other, a bumpy shape formed of a convex part and a concave part whose height in the rotation-axis direction varies continuously is formed along a circumferential direction with the rotation shaft as a center.

* * * * *